US011408647B2

(12) United States Patent
Cogswell et al.

(10) Patent No.: US 11,408,647 B2
(45) Date of Patent: Aug. 9, 2022

(54) ENHANCED THERMALLY-DRIVEN EJECTOR CYCLES

(71) Applicant: CARRIER CORPORATION, Palm Beach Gardens, FL (US)

(72) Inventors: Frederick J. Cogswell, Glastonbury, CT (US); Yinshan Feng, Manchester, CT (US); Parmesh Verma, South Windsor, CT (US); Hongsheng Liu, Shanghai (CN); Dhruv Chanakya Hoysall, West Hartford, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 31 days.

(21) Appl. No.: 16/778,440

(22) Filed: Jan. 31, 2020

(65) Prior Publication Data

US 2020/0248932 A1 Aug. 6, 2020

(30) Foreign Application Priority Data

Feb. 2, 2019 (CN) ..... 201910108502.9

(51) Int. Cl.
*F25B 41/00* (2021.01)
*F25B 1/06* (2006.01)
*F25B 40/04* (2006.01)

(52) U.S. Cl.
CPC ..... *F25B 1/06* (2013.01); *F25B 40/04* (2013.01); *F25B 41/00* (2013.01); *F25B 2341/0012* (2013.01)

(58) Field of Classification Search
CPC ..... F25B 9/08; F25B 2341/0011; F25B 2341/0012
(Continued)

(56) References Cited

U.S. PATENT DOCUMENTS 3,602,295 A 8/1971 Klaas
4,018,583 A 4/1977 Patnode et al.
(Continued)

FOREIGN PATENT DOCUMENTS

CN 1475716 A 2/2004
CN 101097099 A 1/2008
(Continued)

OTHER PUBLICATIONS

Extended European Search Report; International Application No. 20155169.4-1008; International Filing Date: Feb. 3, 2020; dated Jun. 5, 2020; 127 pages.
(Continued)

*Primary Examiner* — Ana M Vazquez
(74) *Attorney, Agent, or Firm* — Cantor Colburn LLP

(57) ABSTRACT

A refrigerated system includes a heat recovery system defining a heat recovery fluid flow path. The heat recovery system includes an ejector having a primary inlet and a secondary inlet and a first heat exchanger within which heat is transferred between a heat recovery fluid and a secondary fluid. The first heat exchanger is located upstream from the primary inlet of the ejector. A second heat exchanger within which heat is transferred from a heat transfer fluid to the heat recovery fluid is upstream from the secondary inlet of the ejector. At least one recovery heat exchanger is positioned along the heat recovery fluid flow path directly upstream from the first heat exchanger.

16 Claims, 6 Drawing Sheets

(58) Field of Classification Search
USPC ..... 62/500
See application file for complete search history.

(56) References Cited

U.S. PATENT DOCUMENTS

| | | | |
|---|---|---|---|
| 4,523,437 | A | 6/1985 | Briley |
| 4,761,970 | A | 8/1988 | MacCracken |
| 6,422,308 | B1 | 7/2002 | Okawara et al. |
| 6,477,857 | B2 | 11/2002 | Takeuchi et al. |
| 6,722,147 | B2 | 4/2004 | Heyl et al. |
| 6,782,713 | B2 | 8/2004 | Takeuchi et al. |
| 6,834,514 | B2 | 12/2004 | Takeuchi et al. |
| 6,837,069 | B2 | 1/2005 | Takeuchi et al. |
| 6,857,286 | B2 | 2/2005 | Ohta et al. |
| 6,901,765 | B2 | 6/2005 | Amaral et al. |
| 7,207,186 | B2 | 4/2007 | Hirota |
| 8,156,754 | B2 | 4/2012 | Hong et al. |
| 8,713,962 | B2 | 5/2014 | Okazaki |
| 9,200,820 | B2 | 12/2015 | Okazaki et al. |
| 9,217,590 | B2 | 12/2015 | Cogswell et al. |
| 10,059,173 | B2 | 8/2018 | Lee et al. |
| 10,094,577 | B2 | 10/2018 | Dennis |
| 10,655,504 | B2 | 5/2020 | Bergweiler |
| 10,823,461 | B2 | 11/2020 | Hellmann |
| 2003/0066301 | A1 | 4/2003 | Takeuchi |
| 2004/0003608 | A1 | 1/2004 | Takeuchi et al. |
| 2004/0103685 | A1 | 6/2004 | Yamaguchi et al. |
| 2006/0254748 | A1 | 11/2006 | Watanabe et al. |
| 2007/0163293 | A1 | 7/2007 | Ikegami et al. |
| 2010/0000713 | A1 | 1/2010 | Takahashi et al. |
| 2010/0101271 | A1 | 4/2010 | Pogadaev |
| 2011/0289953 | A1 | 12/2011 | Alston |
| 2012/0167601 | A1 | 7/2012 | Cogswell et al. |
| 2012/0204596 | A1 | 8/2012 | Takenaka et al. |
| 2013/0042640 | A1 | 2/2013 | Higashiiue et al. |
| 2015/0176868 | A1 | 6/2015 | Kayano et al. |
| 2016/0001636 | A1 | 1/2016 | Terada et al. |
| 2016/0339766 | A1 | 11/2016 | Choi et al. |
| 2017/0159977 | A1 | 6/2017 | Hellmann |
| 2017/0197490 | A1 | 7/2017 | Enomoto et al. |
| 2017/0211850 | A1 | 7/2017 | Fukushima et al. |
| 2017/0307264 | A1 | 10/2017 | Clodic et al. |
| 2018/0142927 | A1 | 5/2018 | Hellmann et al. |
| 2019/0137192 | A1* | 5/2019 | Gil ..... F28D 7/024 |
| 2020/0166248 | A1 | 5/2020 | Kato |
| 2020/0248932 | A1 | 8/2020 | Cogswell et al. |
| 2020/0248938 | A1 | 8/2020 | Liu et al. |
| 2021/0302077 | A1 | 9/2021 | Xu et al. |

FOREIGN PATENT DOCUMENTS

| | | | |
|---|---|---|---|
| CN | 201885295 | U | 6/2011 |
| CN | 103282730 | A | 9/2013 |
| CN | 203857718 | U | 10/2014 |
| CN | 106052178 | A | 10/2016 |
| CN | 205843115 | U | 12/2016 |
| DE | 10061658 | A1 | 9/2001 |
| DE | 10158104 | A1 | 6/2003 |
| DE | 102006042788 | A1 | 3/2008 |
| EP | 0149413 | A2 | 7/1985 |
| EP | 1882890 | A2 | 1/2008 |
| EP | 3385642 | A1 | 10/2018 |
| JP | S5730674 | U | 2/1982 |
| JP | 2003074992 | A | 3/2003 |
| JP | 2005076914 | A | 3/2005 |
| JP | 2005249315 | A | 9/2005 |
| JP | 2008116124 | A | 5/2008 |
| JP | 4396004 | B2 | 1/2010 |
| JP | 2015004460 | A | 1/2015 |
| JP | 5786481 | B2 | 9/2015 |
| WO | 2008034828 | A1 | 3/2008 |
| WO | 2009128271 | A1 | 10/2009 |
| WO | 2012092686 | A | 7/2012 |
| WO | 2013055391 | A1 | 4/2013 |
| WO | 2017192302 | A1 | 11/2017 |
| WO | 2018118609 | A1 | 6/2018 |

OTHER PUBLICATIONS

Chinese Office Action for Application No. 201611189521.1; dated Apr. 26, 2021; 8 Pages.
C. Pollerberg et al.; "Experimental Study on the Performance of a Solar Driven Steam Jet Ejector Chiller"; Energy Conversion and Management, 49; 2008; pp. 3318-3325.
International Preliminary Report on Patentability; International Application No. PCT/US2017/066264; International Filing Date: Dec. 14, 2017; dated Jun. 25, 2019; 8 pages.
International Search Report; International Application No. PCT/US2017/066264; International Filing Date: Dec. 14, 2017; dated Mar. 22, 2018; 5 pages.
Written Opinion; International Application No. PCT/US2017/066264; International Filing Date: Dec. 14, 2017; dated Mar. 22, 2018; 6 pages.
First Office Action; Chinese Patent Application No. 201611189521.1; International Filing Date: Dec. 21, 2016; dated Nov. 3, 2020; 13 pages with translation.
Indian Office Action; International Application No. 201917025804; International Filing Date: Jun. 28, 2019; dated Sep. 30, 2020; 5 pages.
Extended European Search Report; International Application No. 20155172.8-1008; International Filing Date: Feb. 3, 2020; dated Apr. 1, 2020; 7 pages.
Communication pursuant to Article 94(3) EPC; International Application No. 20155172.8-1002; International Filing Date: Feb. 3, 2020; dated May 3, 2021; 5 pages.
European Office Action; European Application No. 17826053.5; dated Sep. 20, 2021; 8 pages.
U.S. Non-Final Office Action; U.S. Appl. No. 16/468,576, filed Jun. 11, 2019; dated Aug. 3, 2021; 29 pages.
U.S. Non-Final Office Action; U.S. Appl. No. 16/779,039, filed Jan. 31, 2020; dated Dec. 15, 2021; 38 pages.
U.S. Final Office Action; U.S. Appl. No. 16/779,039, filed Jan. 31, 2020; dated Mar. 24, 2022; 27 pages.

* cited by examiner

ENHANCED THERMALLY-DRIVEN EJECTOR CYCLES

CROSS-REFERENCE TO RELATED APPLICATIONS

This application claims the benefit of Chinese Application No. 201910108502.9 filed Feb. 2, 2019, the disclosure of which is incorporated herein by reference in its entirety.

BACKGROUND

Embodiments of the present disclosure relate to refrigeration systems, and more particularly, to thermally driven ejector cycles for applications with higher-grade heat sources.

Refrigeration and heat pump systems may be driven by electric or thermal energy. An example of such a system includes an ejector-based cycle, which may have higher coefficient of performance, i.e. efficiency, than absorption cycles; however further development is necessary to achieve a desired efficiency.

BRIEF DESCRIPTION

According to an embodiment, a refrigerated system includes a heat recovery system defining a heat recovery fluid flow path. The heat recovery system includes an ejector having a primary inlet and a secondary inlet and a first heat exchanger within which heat is transferred between a heat recovery fluid and a secondary fluid. The first heat exchanger is located upstream from the primary inlet of the ejector. A second heat exchanger within which heat is transferred from a heat transfer fluid to the heat recovery fluid is upstream from the secondary inlet of the ejector. At least one recovery heat exchanger is positioned along the heat recovery fluid flow path directly upstream from the first heat exchanger.

In addition to one or more of the features described above, or as an alternative, in further embodiments the heat recovery fluid is water.

In addition to one or more of the features described above, or as an alternative, in further embodiments the heat transfer fluid is water.

In addition to one or more of the features described above, or as an alternative, in further embodiments the heat recovery fluid flow path further comprises a primary heat recovery fluid loop and a secondary heat recovery fluid loop, the first heat exchanger and the at least one recovery heat exchanger being positioned along the primary heat recovery fluid loop.

In addition to one or more of the features described above, or as an alternative, in further embodiments the second heat exchanger is positioned along the secondary heat recovery fluid loop.

In addition to one or more of the features described above, or as an alternative, in further embodiments the heat transfer fluid is circulating within a secondary system, the secondary system being thermally coupled to the heat recovery system at the second heat exchanger.

In addition to one or more of the features described above, or as an alternative, in further embodiments the heat transfer fluid is water.

In addition to one or more of the features described above, or as an alternative, in further embodiments the secondary system is a vapor compression system.

In addition to one or more of the features described above, or as an alternative, in further embodiments secondary system fluid is refrigerant.

In addition to one or more of the features described above, or as an alternative, in further embodiments the heat recovery system further comprises: a pump located upstream from the first heat exchanger and a heat rejection heat exchanger arranged downstream from the ejector.

In addition to one or more of the features described above, or as an alternative, in further embodiments the heat recovery fluid at an outlet of the pump is provided to the at least one recovery heat exchanger from the pump.

In addition to one or more of the features described above, or as an alternative, in further embodiments heat recovery fluid from a first portion of the heat recovery fluid flow path and heat recovery fluid from a second portion of the heat recovery fluid flow path are thermally coupled at the at least one recovery heat exchanger.

In addition to one or more of the features described above, or as an alternative, in further embodiments the first portion of the heat recovery fluid flow path is arranged at an outlet of the ejector, and the second portion of the heat recovery flow path is arranged at an outlet of the pump.

In addition to one or more of the features described above, or as an alternative, in further embodiments a first portion of the heat recovery fluid output from the heat rejection heat exchanger is provided to the primary fluid loop and a second portion of the heat recovery fluid output from the heat rejection heat exchanger is provided to the secondary fluid loop.

In addition to one or more of the features described above, or as an alternative, in further embodiments the second portion of the heat recovery fluid is provided to the secondary inlet of the ejector.

In addition to one or more of the features described above, or as an alternative, in further embodiments the at least one recovery heat exchanger includes a first recovery heat exchanger and a second recovery heat exchanger arranged sequentially relative to the heat recovery fluid flow path.

According to another embodiment, a method of operating a refrigeration system including a heat recovery system includes circulating a heat recovery fluid through a heat recovery fluid flow path of the heat recovery system. The heat recovery system includes a heat exchanger for transferring heat between a heat recovery fluid within the heat recovery fluid flow path and a secondary fluid. The method additionally includes transferring heat to the heat recovery fluid within the heat recovery fluid flow path at a location upstream from the heat exchanger. The heat being transferred is provided from another portion of the refrigeration system.

In addition to one or more of the features described above, or as an alternative, in further embodiments transferring heat to the heat recovery fluid within the heat recovery fluid flow path at a location upstream from the heat exchanger includes providing the heat recovery fluid to another heat exchanger within which a first portion of the heat recovery fluid is in a heat exchange relationship with a second portion of the heat recovery fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
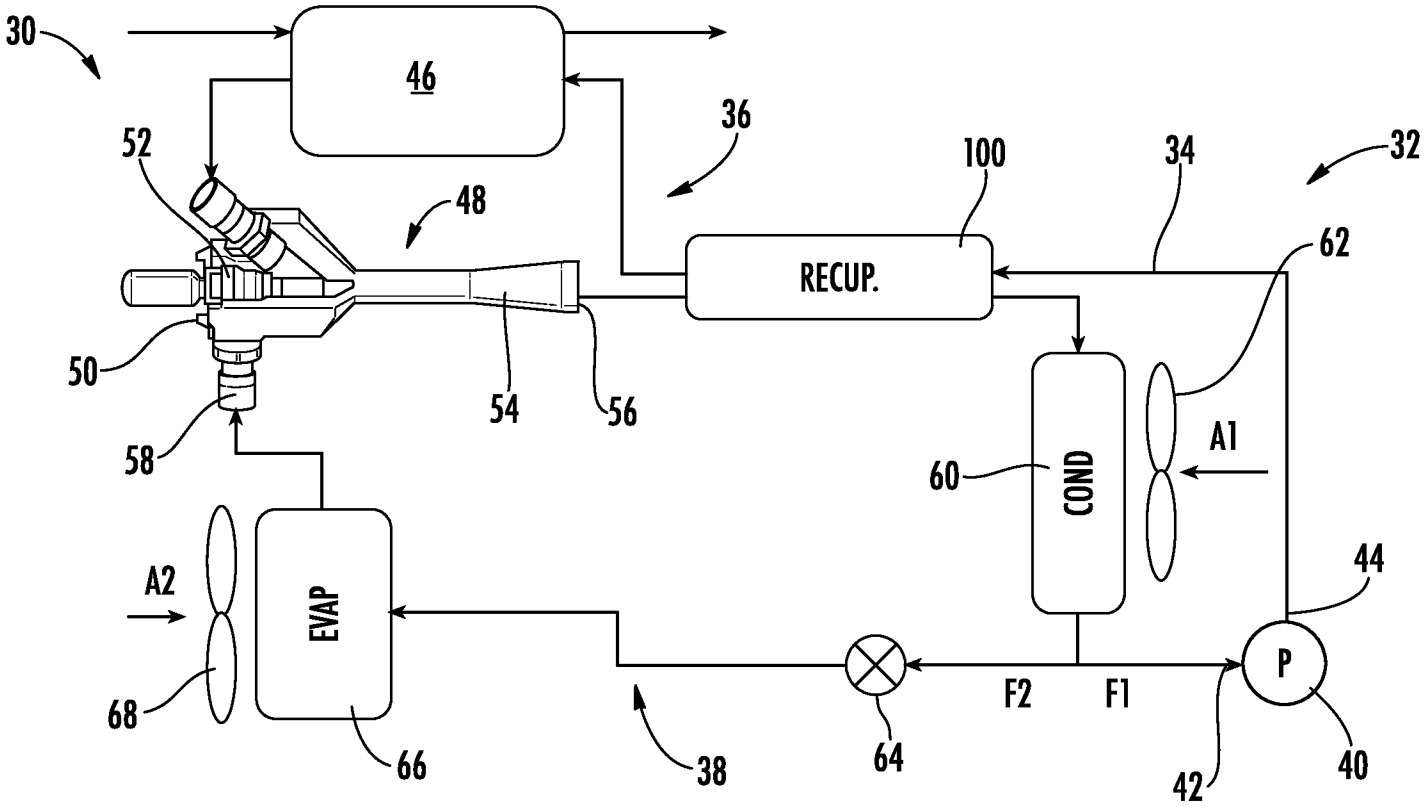
FIG. 1 is a schematic diagram of a refrigeration system according to an embodiment.
Figure 2:
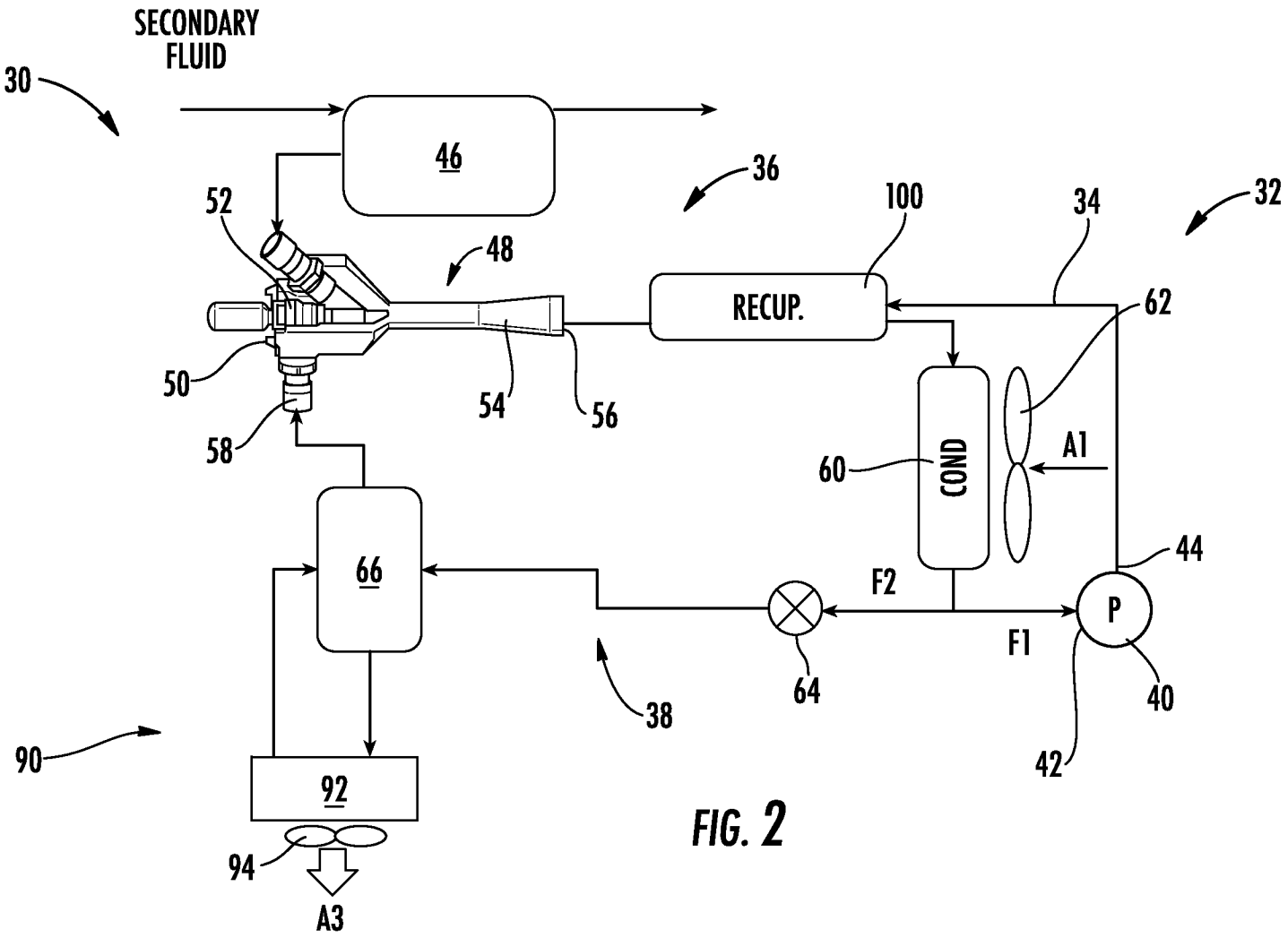
FIG. 2 is a schematic diagram of a refrigeration system according to an embodiment.

With reference now to FIG. 1, an example of the refrigeration system 30 according to an embodiment is shown in more detail. The refrigeration system 30 includes a heat recovery system 32 having a heat recovery fluid flow path 34 through which a heat recovery fluid moves. In an embodiment, the heat recovery fluid is water. However, it should be understood that any suitable heat recovery fluid, including refrigerant, is considered within the scope of the disclosure.

The heat recovery fluid flow path 34 of the heat recovery system 32 includes both a primary heat recovery fluid loop 36 and a secondary heat recovery fluid loop 38 interconnected with one another. The primary heat recovery fluid loop 36 includes a pump 40 having an inlet 42 and an outlet 44. The primary heat recovery fluid loop 36 additionally includes at least one pass through a first portion of a heat exchanger 46 and an ejector 48. In an embodiment, the heat exchanger 46 is a gas burner or steam generator. The ejector 48 has a primary or motive flow inlet 50 at the inlet of a nozzle 52 (e.g. a convergent-divergent nozzle) and an outlet 54 at the downstream end of a diffuser 56. The ejector 48 additionally includes a secondary suction port 58. Sequentially, along the primary heat recovery fluid loop 36 of the heat recovery fluid flow path 34 proceeding downstream from the pump 40 during normal operation, the heat recovery fluid passes through the heat exchanger 46, the primary inlet 50 of the ejector 48, the ejector outlet 54, and another heat exchanger 60 before returning to the pump 40. In the illustrated, non-limiting embodiment, the heat exchanger 60 is a refrigerant-air heat exchanger having a fan 62 driving a respective airflow A1 across the heat exchanger 60.

In the illustrated, non-limiting embodiments, the secondary heat recovery fluid loop 38 is fluidly coupled to the primary heat recovery fluid loop 36 downstream from the heat exchanger 60. As shown, a first portion F1 of the heat recovery fluid output from the heat exchanger 60 is directed to the pump 40 and a second portion F2 of the heat recovery fluid output from the heat exchanger 60 is provided to the secondary heat recovery fluid loop 38. Within this secondary heat recovery fluid loop 38, the heat recovery fluid F2 passes sequentially through an expansion device 64 and another heat exchanger 66 before being returned to the primary heat recovery fluid loop 36 of the heat recovery system 32 via the secondary suction port 58 of the ejector 48.

In an embodiment, the heat exchanger 46 is a generator heat exchanger configured to transfer heat from a secondary fluid to the heat recovery fluid F1 within the primary heat recovery fluid loop 36. Similarly, the heat exchanger 60 is a heat rejection heat exchanger. The heat exchanger 66 arranged within the secondary heat recovery fluid loop 38, upstream from the secondary suction port 58 of the ejector 48, may function as an evaporator or heat absorption heat exchanger, such that the heat recovery fluid F2 within the heat exchanger 66 absorbs heat from another fluid at the heat exchanger 66.

Figure 3:
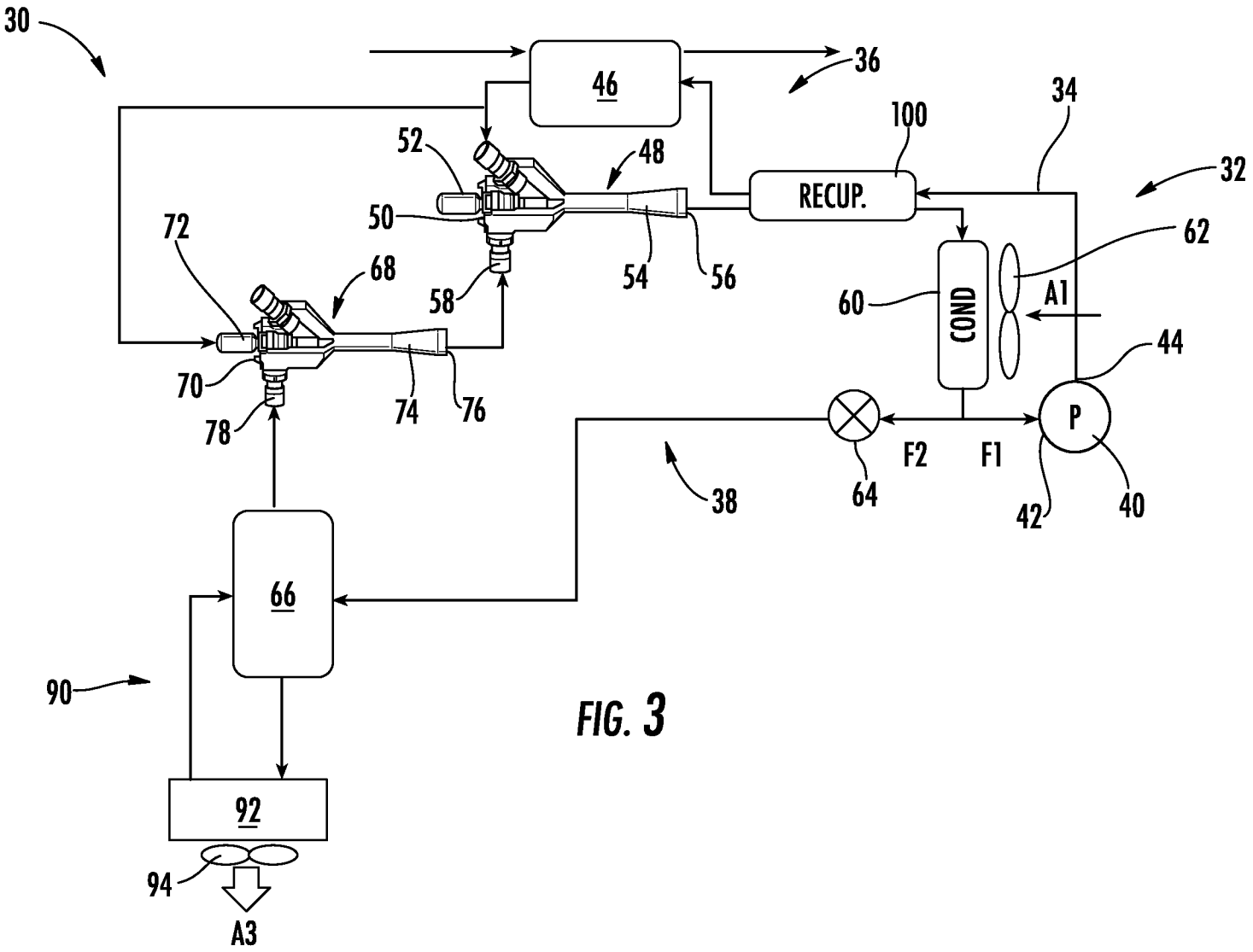
FIG. 3 is a schematic diagram of a refrigeration system according to an embodiment.
Figure 4:
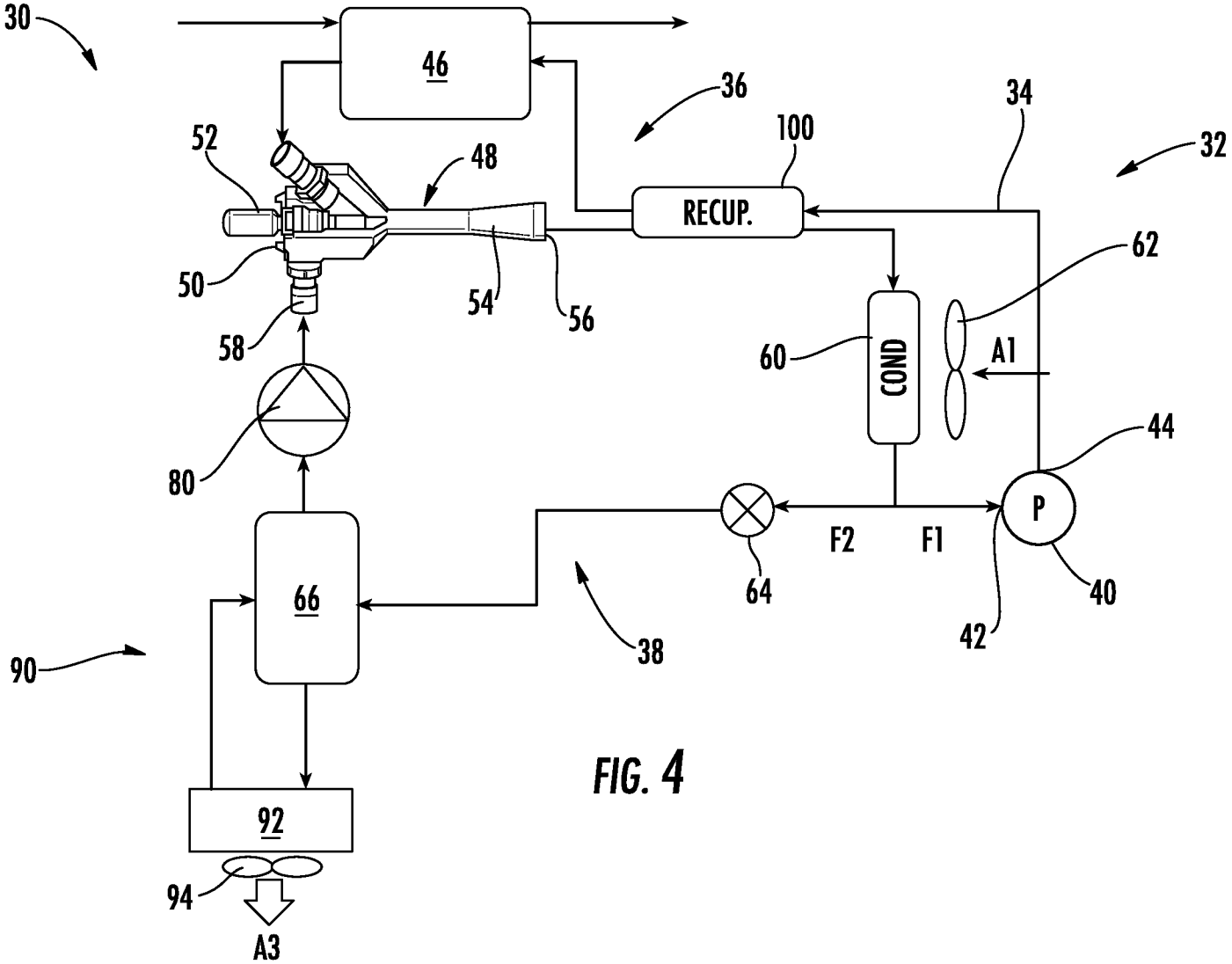
FIG. 4 is a schematic diagram of a refrigeration system according to an embodiment.
Figure 5:
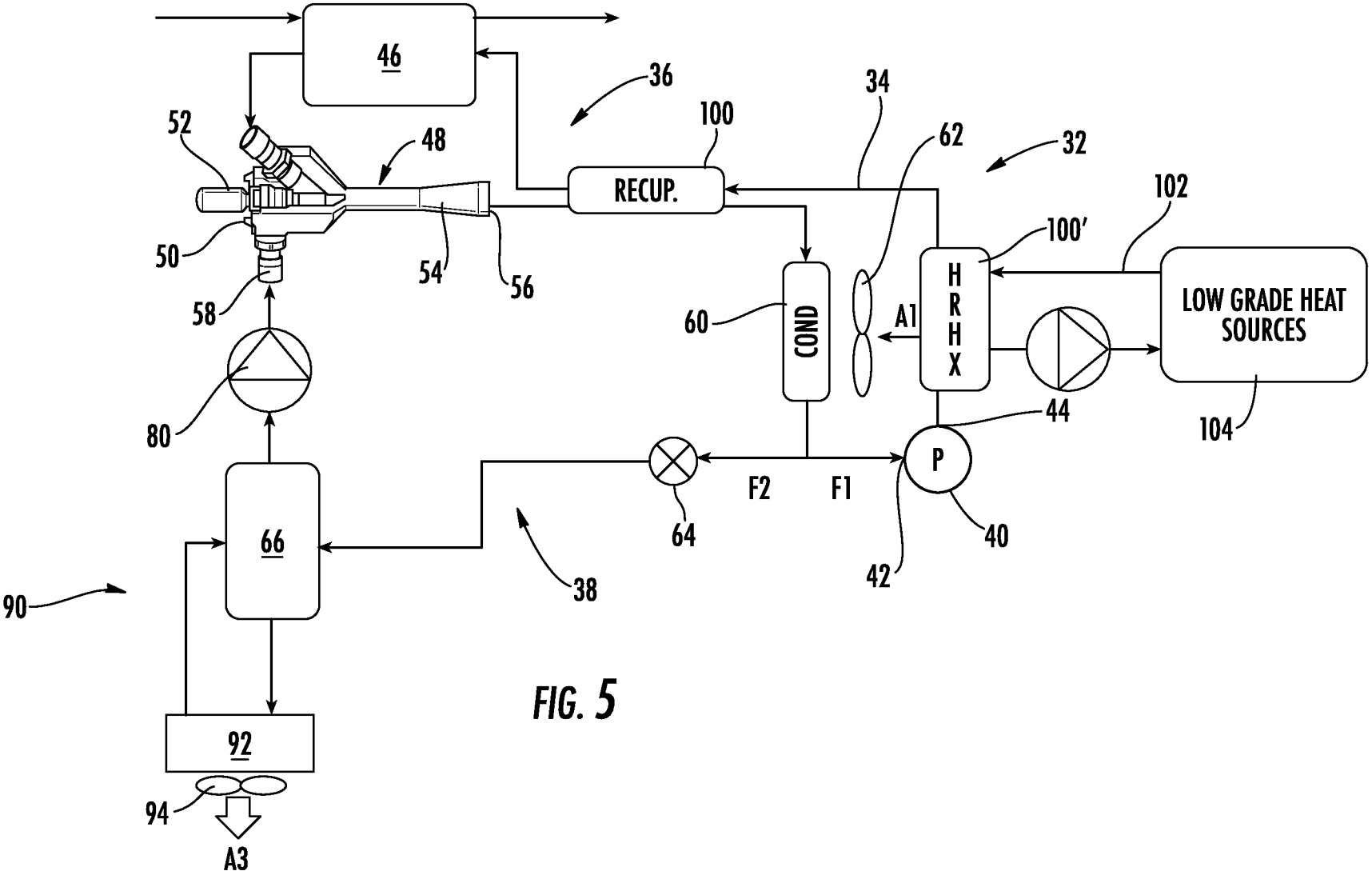
FIG. 5 is a schematic diagram of a refrigeration system according to an embodiment.

With reference now to FIG. 3, in an embodiment, the heat recovery system 32 includes another ejector arranged upstream from the secondary inlet 58 of the ejector 48. The second ejector 68 similarly has a primary or motive flow inlet 70 at the inlet of a nozzle 72 (i.e. a convergent-divergent nozzle) and an outlet 74 at the downstream end of a diffuser 76. The ejector 68 additionally includes a secondary suction port 78. The second ejector 68 provides an interface between the primary heat recovery loop 36 and the secondary heat recovery fluid loop 38. As shown, a portion of the heat recovery fluid output from the heat exchanger 46 is provided to the primary inlet 50 of the ejector 48, and another portion of the heat recovery fluid output from the heat exchanger 46 is provided to the primary inlet 70 of the ejector 68. The secondary heat recovery fluid loop 38 is connected to the secondary suction port 78 of the second ejector 68. Accordingly, a mixture of the heat recovery fluid provided at the primary inlet 70 and the secondary inlet 78 is delivered to the secondary suction port 58 of the ejector 48. Alternatively or in addition, a compressor 78 is positioned downstream from the heat exchanger 66 and upstream from the secondary suction port 58 of the ejector 48 (see FIGS. 4-6).

Regardless of the configuration of the heat recovery system 32, a heat transfer fluid is provided to the heat exchanger 66 to transfer heat to the heat recovery fluid F2 therein. In an embodiment, the heat transfer is a warm air provided from any suitable source. Referring again to FIG. 1, the heat exchanger 66 may be positioned directly within an existing flow path of the heated air, or alternatively, a fan 68 may be used to move the air, such as airflow A2 for example, across the heat exchanger 66 as shown in FIG. 1.

With reference now to FIGS. 2-6, in another embodiment, the heat transfer fluid provided to the heat exchanger 66 may be a fluid S circulating within another system 90 thermally coupled to the heat recovery system 32 at the heat exchanger 66. The heat transfer fluid S may be water, refrigerant, or any other suitable fluid. Further, the system 90 may include one or more additional components, illustrated schematically at 92, such as another heat exchanger, air handling unit, or fan coil unit for example. During normal operation of the system 90, the heat exchanger 66 is a heat rejection heat exchanger, i.e. a condenser or gas cooler, and the component 92 is a heat absorption heat exchanger, i.e. an evaporator. In the illustrated, non-limiting embodiment, the heat exchanger 92 is a refrigerant/water-air heat exchanger having a fan 94 operable to drive an airflow A3 across the component 92. Accordingly, the air A3 that is cooled as it flows across the heat exchanger 92 is provided to an area being conditioned by the refrigeration system. It should be understood that the configurations of the refrigeration system 30, and in particular the heat recovery system 32 and the system 90 illustrated herein are intended as examples only. Embodiments of either the heat recovery system 32 or the system 90 including additional components not described herein are also within the disclosure. For example, in an embodiment, the system 90 may be a vapor compression system and may additionally include a compressor and heat expansion device (not shown).

It is desirable to increase the temperature of the heat recovery fluid provided to the heat exchanger 46 as it reduces the amount of recovery heat required for a given benefit to the refrigeration system 30, or conversely, it allows for an increased benefit to the refrigeration system 30 for a given amount of recovery heat. With reference now to the disclosed embodiments of the refrigeration system 30, one or more components within the refrigeration system 30 may be used to increase the temperature of the heat recovery fluid provided to the heat exchanger 46. More specifically, any portion of the fluid within either the heat recovery fluid flow path 34 or the flow path of the system 90 having a temperature above a condensing temperature thereof may be used to increase the temperature of the heat recovery fluid upstream from the heat exchanger 46.

The heat recovery system 32 additionally includes a heat exchanger 100 configured to heat the heat recovery fluid upstream from the heat exchanger 60. As shown, the heat exchanger 100 may be located directly upstream from the heat exchanger 46 such that the heat recovery fluid does not pass through any additional system components, except for possibly a conduit, between the heat exchanger 100 and the heat exchanger 46. In an embodiment, the heat exchanger 100, may be a recovery fluid-recovery fluid heat exchanger for example, where heat recovery fluid from different portions of the heat recovery fluid flow path are the first fluid and the second fluid within the heat exchanger 100. As shown, a first portion of the heat exchanger 100 is positioned downstream from the ejector outlet 56 and upstream from the heat exchanger 60. As a result, the heat recovery fluid output from the ejector 48 functions as a first fluid within the first portion of the heat exchanger 100. In such embodiments, the circuiting of the heat recovery fluid flow path 34 may be configured such that a second portion of the heat exchanger 100 configured to receive a second fluid is positioned between the pump 40 and the heat exchanger 46. Accordingly, the cool heat recovery fluid output from the pump 40 is provided to the heat exchanger 100. Within the heat exchanger 100, the heat recovery fluid output from pump 40 absorbs heat from the heat recovery fluid output from the ejector 48. The resulting heat recovery fluid output from the heat exchanger 100 is then provided to the heat exchanger 46 to recover the heat of a secondary fluid provided to the heat exchanger 46.

Figure 6:
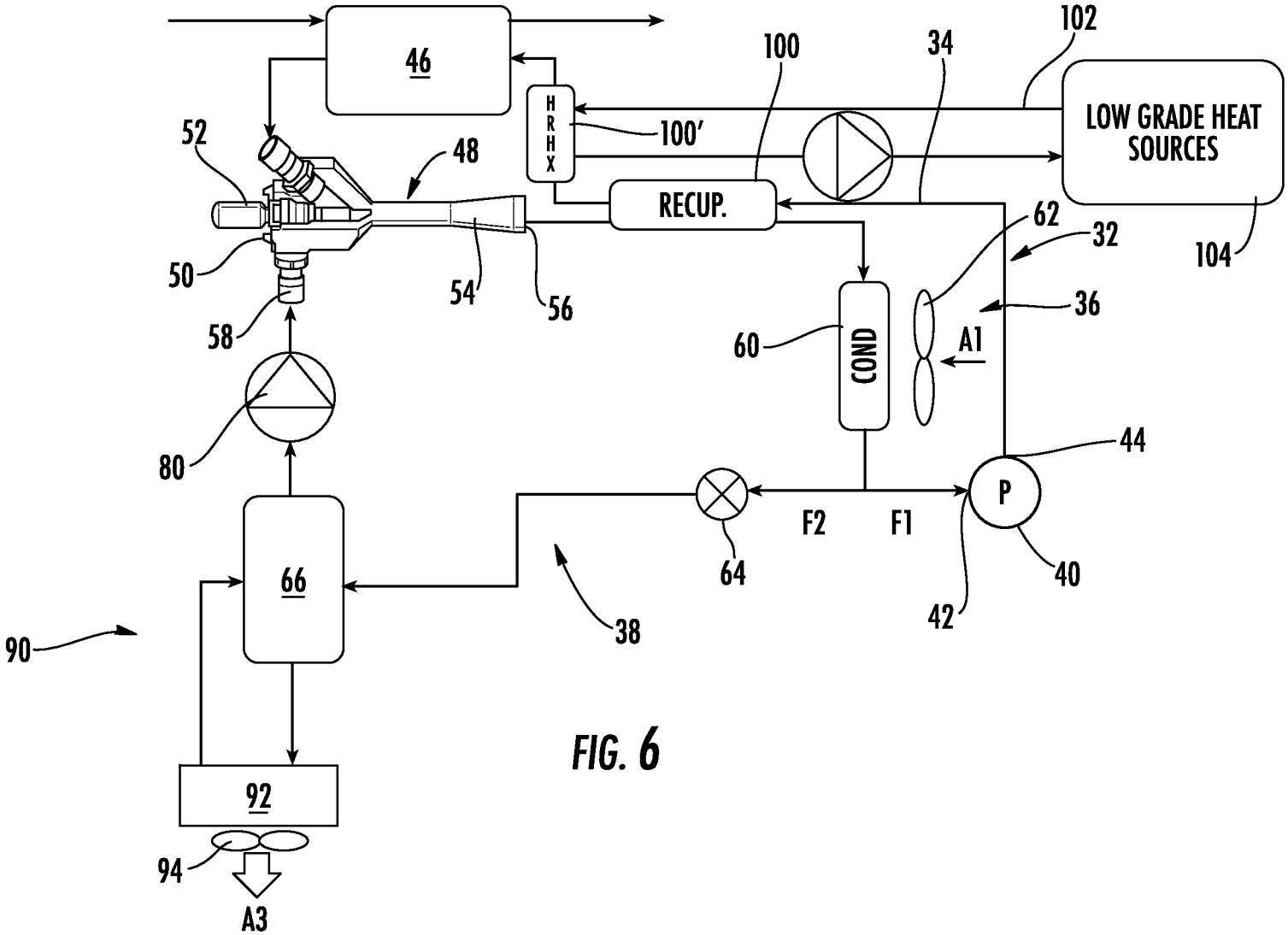
FIG. 6 is a schematic diagram of a refrigeration system according to an embodiment.

Alternatively, or in addition, the refrigerant system 30 may include a heat exchanger 100'. The heat exchanger 100' is connected via a fluid loop 102 with one or more low grade heat sources, illustrated schematically at 104. The heat exchanger 100' is similarly positioned downstream from the pump 40 and upstream from the heat exchanger 46. In embodiments where the heat recovery system 32 additionally includes heat exchanger 100, the heat exchanger 100' may be located upstream from the heat exchanger 100 (see FIG. 5), such that heat recovery fluid is configured to flow through the pump, heat exchanger 100', heat exchanger 100, and heat exchanger 46 sequentially. Alternatively, the heat exchanger 100' may be located downstream from the heat exchanger 100, as shown in FIG. 6. In such embodiments, the heat recovery fluid is configured to flow through the pump, heat exchanger 100, heat exchanger 100', and heat exchanger 46 sequentially.

Inclusion of both heat exchangers 100, 100' further increases the temperature of the heat recovery fluid used to recover the fluid within the heat exchanger 46. In addition, although specific configurations of the refrigeration system 30 and the corresponding positions of the heat exchangers 100, 100' therein are illustrated and described herein, it should be understood that the heat exchanger may be arranged at any suitable location within the refrigeration system 30. More specifically, the heat exchangers 100, 100' may be located at any position where the heat recovery fluid has a temperature greater than at least one of an outside ambient temperature and a condensing temperature of the fluid (whichever is lowest).

A refrigeration system 30 as illustrated and described herein has an increased operational efficiency compared to existing system by using waste heat at various external ambient conditions and load to be recovered. As result, the size and/or power required by various components of the refrigeration system 30 may be reduced.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A refrigerated system comprising:

a heat recovery system defining a heat recovery fluid flow path, the heat recovery system including:

an ejector having a primary inlet and a secondary inlet;

a first heat exchanger within which heat is transferred between a heat recovery fluid and a secondary fluid, the first heat exchanger being located upstream from the primary inlet of the ejector;

a second heat exchanger within which heat is transferred from a heat transfer fluid to the heat recovery fluid, the second heat exchanger being located upstream from the secondary inlet of the ejector; and at least one recovery heat exchanger positioned along the heat recovery fluid flow path upstream from the first heat exchanger;

wherein the heat recovery fluid flow path further comprises a primary heat recovery fluid loop and a secondary heat recovery fluid loop, the first heat exchanger and the at least one recovery heat exchanger being positioned along the primary heat recovery fluid loop; and wherein the at least one recovery heat exchange is connected with a low grade heat source via a fluid loop separate from the primary heat recovery fluid loop and the secondary hear recovery fluid loop.

2. The refrigerated system of claim 1, wherein the heat recovery fluid is water.

3. The refrigerated system of claim 1, wherein the heat transfer fluid is water.

4. The refrigerated system of claim 1, wherein the second heat exchanger is positioned along the secondary heat recovery fluid loop.

5. The refrigerated system of claim 4, wherein the heat transfer fluid is circulating within a secondary system, the secondary system being thermally coupled to the heat recovery system at the second heat exchanger.

6. The refrigerated system of claim 5, wherein the heat transfer fluid is water.

7. The refrigerated system of claim 5, wherein the secondary system is a vapor compression system.

8. The refrigerated system of claim 7, wherein secondary system fluid is refrigerant.

9. The refrigerated system of claim 1, wherein the heat recovery system further comprises:

a pump located upstream from the first heat exchanger; and a heat rejection heat exchanger arranged downstream from the ejector.

10. The refrigerated system of claim 9, wherein the heat recovery fluid at an outlet of the pump is provided to the at least one recovery heat exchanger from the pump.

11. The refrigerated system of claim 9, wherein heat recovery fluid from a first portion of the heat recovery fluid flow path and heat recovery fluid from a second portion of the heat recovery fluid flow path are thermally coupled at the at least one recovery heat exchanger.

12. The refrigerated system of claim 11, wherein the first portion of the heat recovery fluid flow path is arranged at an outlet of the ejector, and the second portion of the heat recovery flow path is arranged at an outlet of the pump.

13. The refrigerated system of claim 9, wherein a first portion of the heat recovery fluid output from the heat rejection heat exchanger is provided to the primary fluid loop and a second portion of the heat recovery fluid output from the heat rejection heat exchanger is provided to the secondary fluid loop.

14. The refrigerated system of claim 13, wherein the second portion of the heat recovery fluid is provided to the secondary inlet of the ejector.

15. The refrigerated system of claim 1, wherein the at least one recovery heat exchanger includes a first recovery heat exchanger and a second recovery heat exchanger arranged sequentially relative to the heat recovery fluid flow path.

16. A method of operating a refrigeration system including a heat recovery system comprising:

circulating a heat recovery fluid through a primary heat recovery fluid flow path and a second heat recovery fluid flow path of the heat recovery system in parallel;

transferring heat between a heat recovery fluid within the primary heat recovery fluid flow path and a secondary fluid at a first heat exchanger arranged upstream from a primary inlet of an ejector;

transferring heat between a heat recovery fluid within the secondary heat recovery fluid flow path and a heat transfer fluid at a second heat exchanger arranged upstream form a secondary inlet of the ejector; and transferring heat to the heat recovery fluid within primary heat recovery fluid flow path at a location upstream from the first heat exchanger, the heat being transferred from another portion of the refrigeration system via a fluid loop separate from the primary heat recovery fluid flow path and the secondary heat recovery fluid flow path.

* * * * *